US007331801B1

(12) United States Patent
Eichorn

(10) Patent No.: US 7,331,801 B1
(45) Date of Patent: Feb. 19, 2008

(54) TOP MOUNT RIGHT ANGLE HEADER

(75) Inventor: Daniel S. Eichorn, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/706,535

(22) Filed: Feb. 15, 2007

Related U.S. Application Data

(63) Continuation-in-part of application No. 11/496,682, filed on Jul. 31, 2006, now Pat. No. 7,201,587.

(51) Int. Cl.
*H01R 12/00* (2006.01)

(52) U.S. Cl. ..... 439/79; 439/76.1; 439/926

(58) Field of Classification Search ..... 439/79, 439/587, 76.1, 926
See application file for complete search history.

(56) References Cited

U.S. PATENT DOCUMENTS 5,256,072 A * 10/1993 Hatagishi ..... 439/79
5,511,984 A 4/1996 Olson et al.
5,599,208 A 2/1997 Ward
5,713,746 A 2/1998 Olson et al.
5,718,606 A 2/1998 Rigby et al.
6,093,032 A * 7/2000 McHugh et al. ..... 439/79
6,102,739 A * 8/2000 Murakami ..... 439/587
6,171,116 B1 1/2001 Wicks et al.
6,554,642 B1 * 4/2003 Xiang et al. ..... 439/567
6,572,412 B2 * 6/2003 Beuther et al. ..... 439/620.21
6,676,449 B2 * 1/2004 Ji et al. ..... 439/607
6,733,302 B1 * 5/2004 Smalley, Jr. et al. ..... 439/65
6,823,638 B2 * 11/2004 Stanchfield ..... 52/588.1
7,175,447 B2 * 2/2007 Pan ..... 439/79
7,188,456 B2 * 3/2007 Knauseder ..... 52/592.1

* cited by examiner

*Primary Examiner*—Tho D. Ta
(74) *Attorney, Agent, or Firm*—David P. Wood

(57) ABSTRACT

An electrical connection header for an electrical device and a method for assembling the same are disclosed herein. A connection header may include a plurality of electrical pins, each of which has a first portion and a second portion oriented generally orthogonal to each other. The pins may be inserted to a connector shroud which defines a plurality of apertures for receiving the first portions of the pins. A hood may be secured to the connector shroud such that the hood extends beyond a bend point of at least one of the pins.

29 Claims, 4 Drawing Sheets

TOP MOUNT RIGHT ANGLE HEADER

RELATED APPLICATIONS

This patent application is a continuation-in-part of U.S. patent application Ser. No. 11/496,682 filed on Jul. 31, 2006 U.S. Pat. No. 7,201,587, the complete disclosure of which is incorporated herein by reference in its entirety.

BACKGROUND

Printed circuit boards (PCBs) are used in a wide variety of electronic devices including household appliances, motor vehicles, computers, and even children's toys. The PCBs are generally mounted within a housing that protects the PCB and facilitates installation into a particular application. In most cases, the PCB is connected to the electronic devices through a plug-in and mating connector combination that attaches to the PCB through an opening in the housing. The plug-in connector includes a plurality of wires or "pins" that extend between the mating connector and the PCB. The PCB may thus be integrated into the electrical device as a modular component and easily installed or removed for service or replacement by connecting or disconnecting the plug-in connector. In one example, an electrical system for a motor vehicle employs a PCB housed within an aluminum casting and mounted on an interior surface of the vehicle. A plug-in connection header is assembled as part of the housing to allow the mating connector to interface with the PCB. The housing thus generally protects the PCB from contaminants and damage, while the connection header provides a reliable electrical connection between the electrical system and the PCB.

In known configurations, connection headers may employ a connector shroud that retains pins for contact with the PCB, and receives a mating connector for coupling with the pins. The connector shroud extends beyond a bend point of the pins to attach to the PCB housing. The connector shroud, therefore, must have a tall profile to allow pin bending tools to access the pins that are inserted into the connection header during assembly. Taller header profiles generally increase the overall size of the device and may require complex part assemblies that are expensive to produce in mass manufacturing environments. Further, connector pins are generally thin wires that are delicate and susceptible to bending or misalignment, as may occur during shipment or installation. Known connection headers therefore typically include an alignment feature, which aligns the pins for contact with the PCB. However, known alignment features generally do not withstand vibration and shock, and may allow pins to become misaligned or dislodged from the PCB during assembly and use.

Accordingly, there is a need in the art for a connection header, which provides a low profile to minimize space in the housing, allows for efficient assembly, and protects connector pins from misalignment during assembly and operation.

SUMMARY

Various embodiments directed to an electrical connection header for an electrical device and a method for assembling an electrical connection header for an electrical device are disclosed herein. An illustrative embodiment of an electrical connection header includes a plurality of electrical pins, each of which has a first portion and a second portion oriented generally orthogonal to each other. The pins may be inserted to a connector shroud, which defines a plurality of apertures for receiving the first portions of the pins. A hood may be secured to the connector shroud such that the hood extends beyond a bend point of at least one of the pins.

An illustrative embodiment of a method for assembling a connection header may include inserting a first portion of a plurality of pins into a plurality of apertures defined by a connector shroud. The method may further include bending the pins to form a second portion of each pin that is oriented generally orthogonal to the first portion of the pins, and securing a hood to the shroud such that the hood extends beyond a bend point of at least one of the pins.

DETAILED DESCRIPTION

A plug-in connector for an electrical device is provided. The plug-in connector generally includes a plurality of pins that are inserted into a connector shroud and a hood, which attaches to the connector shroud and extends beyond a bend point of the pins. The configuration of the hood allows for bending tools to freely access the pins during assembly. The plug-in connector may also include a pin alignment guide to engage the pins and align them with a printed circuit board (PCB). The pin alignment guide may include at least one feature for abutting a top surface of a PCB housing to prevent the pin alignment guide from being displaced, and especially from contacting the PCB.

Figure 1:
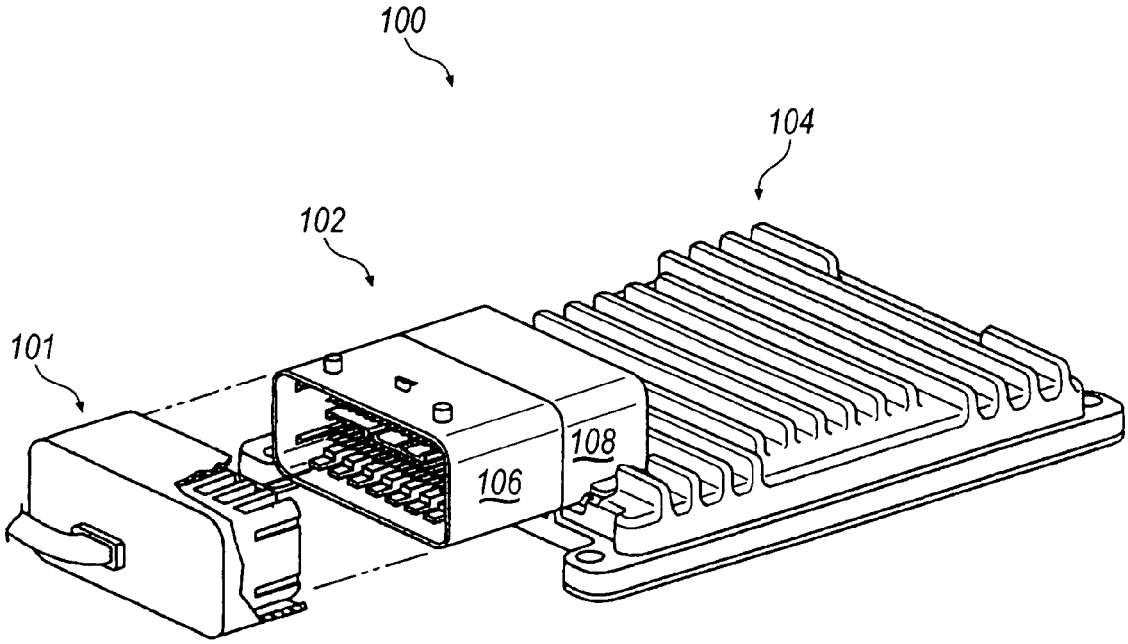
FIG. 1 is a perspective view of an exemplary connection header assembled with a PCB housing.
Figure 2:
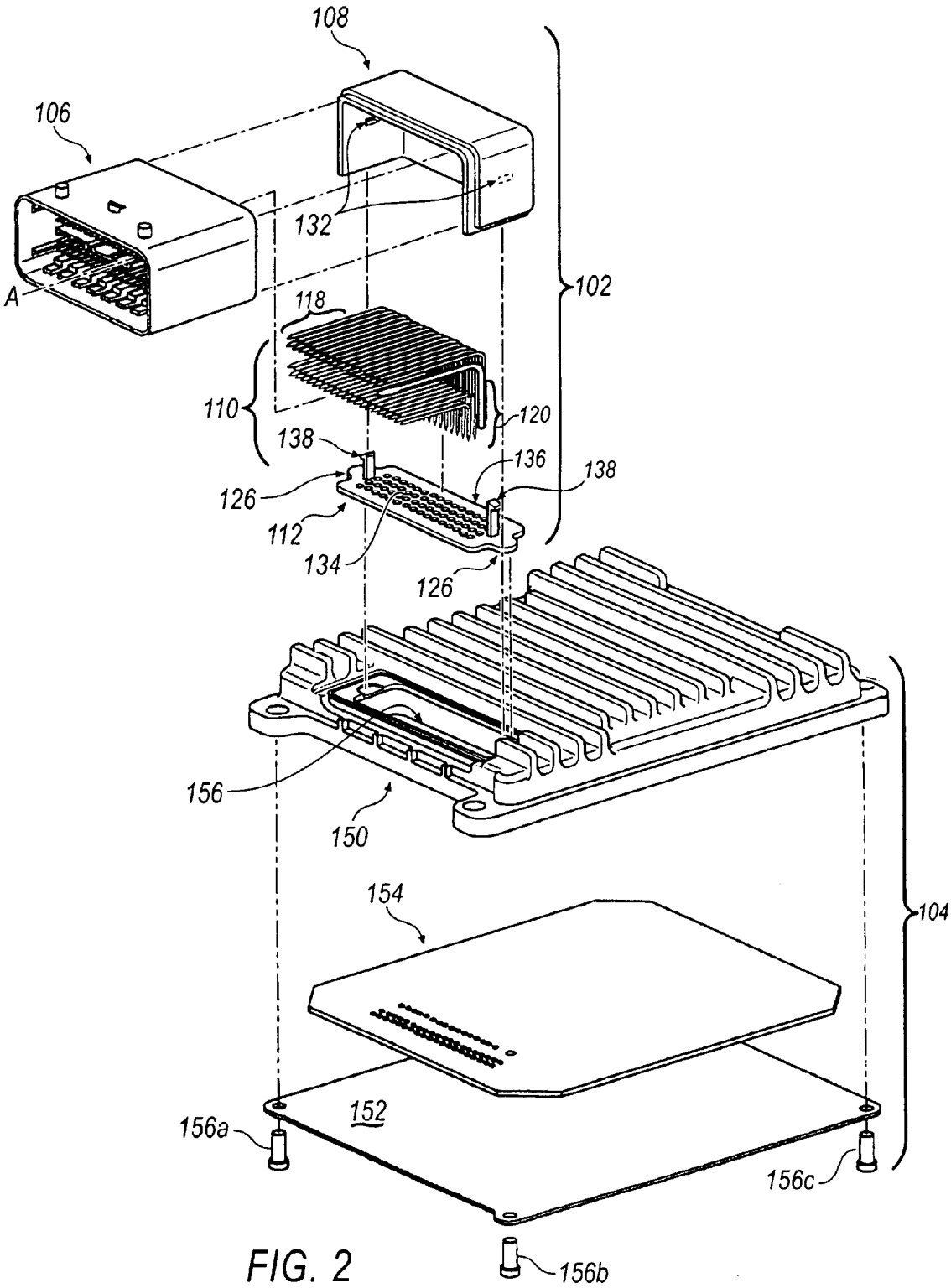
FIG. 2 is an exploded perspective view of an exemplary connection header and PCB housing.

FIG. 1 illustrates an exemplary plug-in connector 100 configured to receive a mating connector 101. Plug-in connector 100 generally includes a housing 104 and a header assembly 102. Turning to FIG. 2, housing 104 may include an upper portion 150 and a lower portion 152 that enclose a PCB 154. Lower portion 152 of housing 104 may be secured to upper portion 150 with a plurality of fasteners 156 *a,b,c,d*. Features may be provided within housing 104 to position PCB 154 for engagement with pins 110, as will be further described below. Further, any other known configuration of housing 104 may be employed. Upper portion 150 of housing 104 has an opening 156, which receives header assembly 102 and allows access to PCB 154. Header assembly 102 generally includes a connector shroud 106 that is shaped to correspond with mating connector 101. A variety of configurations of mating connector 101 may be used in conjunction with connector shroud 106 for providing a connection between plug-in connector 100 and an electrical device. Header assembly 102 further includes a hood 108, which secures to connector shroud 106 and extends beyond bend points 111 *a,b,c,d* (collectively, 111) of pins 110*a,b,c,d* (collectively, 110), as will be described further below. Hood 108 thus generally conceals pins 110. When header 102 is assembled, a first portion 118 of pins 110 are retained within connector shroud 106, while a second portion 120 of pins 110 are aligned by a pin alignment guide 112. Pin alignment guide 112 is adjacent to housing 104 for engagement with PCB 154. Pin alignment guide 112 may be received by one or both of connector shroud 106 and hood 108 for engagement therewith, as will be further described below. Pin alignment guide 112 preferably has at least one abutment feature 126 for abutting a top surface of housing 104.

Figure 3:
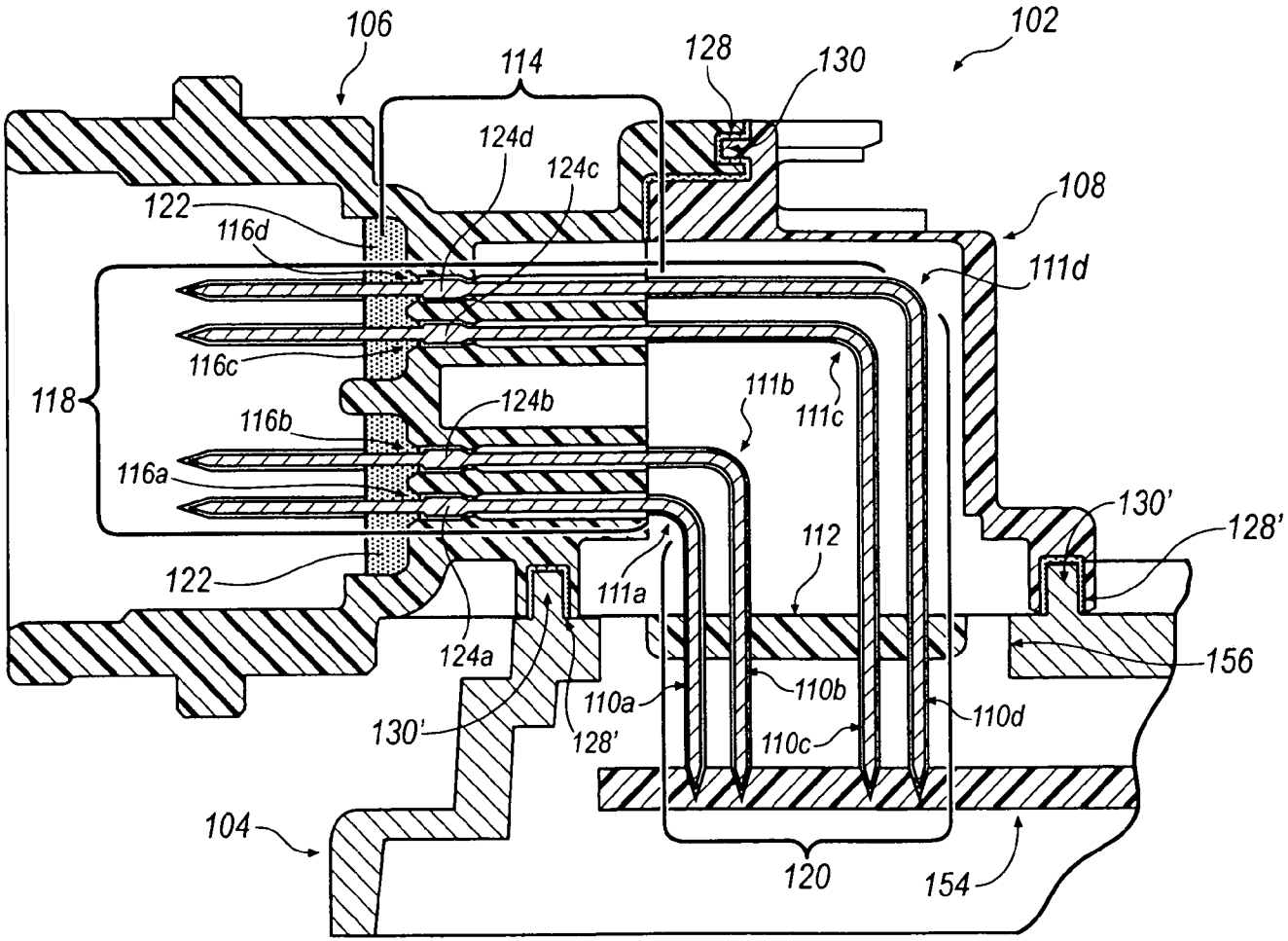
FIG. 3 is a side section view of an exemplary connection header and PCB housing assembly.

FIG. 3 illustrates a side section view of header assembly 102 as shown in FIG. 2. Connector shroud 106 includes a pin block 114, which generally retains four rows of pins 110 *a,b,c,d* (collectively, 110). A greater or lesser number of rows of pins may be employed. Pins 110 may be formed of any known conductive material, and are bent to form first portion 118 and second portion 120. Second portion 120 is generally orthogonal to first portion 118. Second portion 120 engages PCB 154 to provide an electrical connection with mating connector 101 through pin 110. First portion 118 is generally retained within connector shroud 106 by an interference fit between pins 110 and apertures 116. Pins 110 may be configured into any size or shape, including but not limited to, circular or square. A pin sealant 122 may be applied about pins 110 adjacent apertures 116 to provide a sealed connection. Pin sealant 122 is shown disposed about pins 110 adjacent a front end of pin block 114, but may be applied to either side of pin block 114 to seal an interface between pins 110 and pin apertures 116. Pin sealant 122 may include a variety of known sealants, which may be applied in semi-liquid form and hardened to provide a seal that generally prevents intrusion of moisture, dirt or other contaminants through pin apertures 116.

Pin block 114 may be integrally formed within connector shroud 106, such as by a molding process. Other known configurations for pin block 114 may be employed. Pin block 114 defines a plurality of apertures 116 *a,b,c,d*, which may be arranged in four spaced rows for receiving four corresponding rows of pins 110 *a,b,c,d*. Pins apertures 116 may be arranged in a greater or lesser number of rows, or other known configurations, according to a desired arrangement of pins 110. A first portion 118 of pins 110 is retained in pin block 114. Pins 110 may generally be inserted into either end of connector shroud 106 and extend through pin block 114 for engagement with mating connector 101 (not shown in FIG. 3). Further, pins 110 may be provided with an expanded feature 124 for engaging an interior surface of pin apertures 116 to improve retention of pins 110 into pin apertures 116. For example, pins 110 may have a star-shaped cross-section, wherein each extension of the star-shaped cross-section generally digs into material forming pin apertures 116. Connector shroud 106 may additionally include various known features for protecting pins 110 from damage during insertion of mating connector 101 (not shown in FIG. 3). For example, anti-scooping supports (not shown in FIG. 3) may be utilized to minimize deflection of first portion 118 of pins 110 during insertion of mating connector 101. Anti-scooping supports may extend from connector shroud 106 to support first portions 118 of pins 110 during coupling of plug-in connector 100 with mating connector 101, and generally inhibit bending of first portions 118. Advantageously, connector shroud 106 does not extend substantially beyond bend point 111 of pins 110, such that bending tools may freely access pins 110 during assembly of connection header 102 without interference from connector shroud 106. Additionally, connector shroud 106 may have a minimal standover height above housing 104 that is generally dictated by the number of rows of pins 110 that are desired for header assembly 102.

Hood 108 generally protects pins 110 from damage or other interference by external objects or contaminants such as dirt, moisture, etc. Hood 108 generally extends beyond bend point 111, such that removal of hood 108 allows access to at least one row of pins 110. In particular, hood 108 may extend at least beyond a bend point 111*d* of a top row of pins 110*d*, thereby allowing bending tools to generally freely access pins 110*d* for bending during assembly of connection header 102. Hood 108 may generally be configured according to pins 110, such that hood 108 may advantageously be large enough to generally conceal pins 110 while minimizing the overall size of connection header 102. Hood 108 may be secured to an end of connector shroud 106 adjacent housing 104 by any method that is convenient. For example, as shown in FIG. 3, a groove 128 may be provided in connector shroud 106, which complements an extension feature or "tongue" 130 about a perimeter of hood 108. Furthermore, a sealant or adhesive may be applied about an interface between hood 108 and connector shroud 106 to prevent intrusion of moisture, dirt and other contaminants. For example, a sealant or adhesive may be applied within groove 128 of connector shroud 106. Other methods of securing hood 108 to connector shroud 106 may be employed, including, but not limited to, laser welding or ultrasonic welding, wherein a flange of hood 108 or connector shroud 106 may be joined to a corresponding flange of connector shroud 106 or hood 108, respectively. A sealed interface between hood 108 and connector shroud 106 may generally improve durability of header assembly 102 and protect pins 110 from external contaminants. Hood 108 may also include one or more detents 132 disposed on an interior surface of hood 108 (see FIG. 2) or other features for receiving a corresponding feature of pin alignment guide 112, as will be described further below. Hood 108 may further be provided with features for engaging housing 104. For example, similar to the tongue/groove engagement feature described for hood 108 and connector shroud 106, hood 108 may be provided with a groove 128' which engages an extension feature or tongue 130' provided in housing 104. Further, an adhesive or sealant may be disposed on either groove 128' or tongue 130' to further seal an interface between hood 108 and housing 104. Groove 128' may advantageously retain excess glue or sealant when the adhesive or sealant is first disposed within groove 128' and tongue 130' is subsequently inserted into groove 128', as opposed to applying adhesive or sealant to tongue 130' first. Furthermore, any other features for securing hood 108 to housing 104 may be provided as an alternative or in addition to the tongue/groove features described herein.

As shown in FIGS. 2 and 3, pin alignment guide 112 generally improves alignment of pins 110 with respect to PCB 154. For example, a plurality of apertures 134 may be provided in a base portion 136 of pin alignment guide 112 to surround or otherwise engage second portion 120 of each pin 110. Lateral displacement of second portion 120 of pins 110 is thereby reduced, generally preventing misalignment of pins 110 relative to an associated contact point on PCB 154. Pin alignment guide 112 may be secured to hood 108 or connector shroud 106. For example, pin alignment guide 112 may include lock arms 138 (see FIG. 2) extending upwards from base portion 136 to engage detent 132 or any other corresponding feature in hood 108, thereby securing pin alignment guide 112 to hood 108. Lock arms 138 are preferably compliant to allow deflection when pin alignment guide 112 is inserted into hood 108 such that pin alignment guide 112 may be moved into hood 108 until lock arms 138 engage detent 132. Further, engagement between lock arms 138 and detent 132 generally resists removal of pin alignment guide 112 from hood 108. Other features may be provided in pin alignment guide 112 and/or hood 108 and connector shroud 106 as an alternative to lock arms 138 for securing pin alignment guide 112 to hood 108 and/or connector shroud 106. Pin alignment guide 112 may further be provided with at least one abutment feature 126 for preventing pin alignment guide 112 from being displaced into opening 156 if lock arms 138 become disengaged from detents 132. Abutment feature 126 preferably rests upon a top surface of device housing 104, thereby preventing pin alignment guide 112 from intruding through opening 156 toward PCB 154, and especially from contacting PCB 154. Abutment feature 126 thus improves retention of pin alignment feature 112, increasing an ability of header assembly 102 to withstand vibration or shock which might otherwise dislodge pin alignment guide 112 from hood 108 and/or connector shroud 106. For example, abutment feature 126 may include an extension which rests upon an upper surface of housing 104 adjacent aperture 156, as shown in FIG. 2. A variety of other abutment features 126 may be provided to engage an upper surface of housing 104 as an alternative or in addition to that illustrated in FIG. 2.

Figure 4:
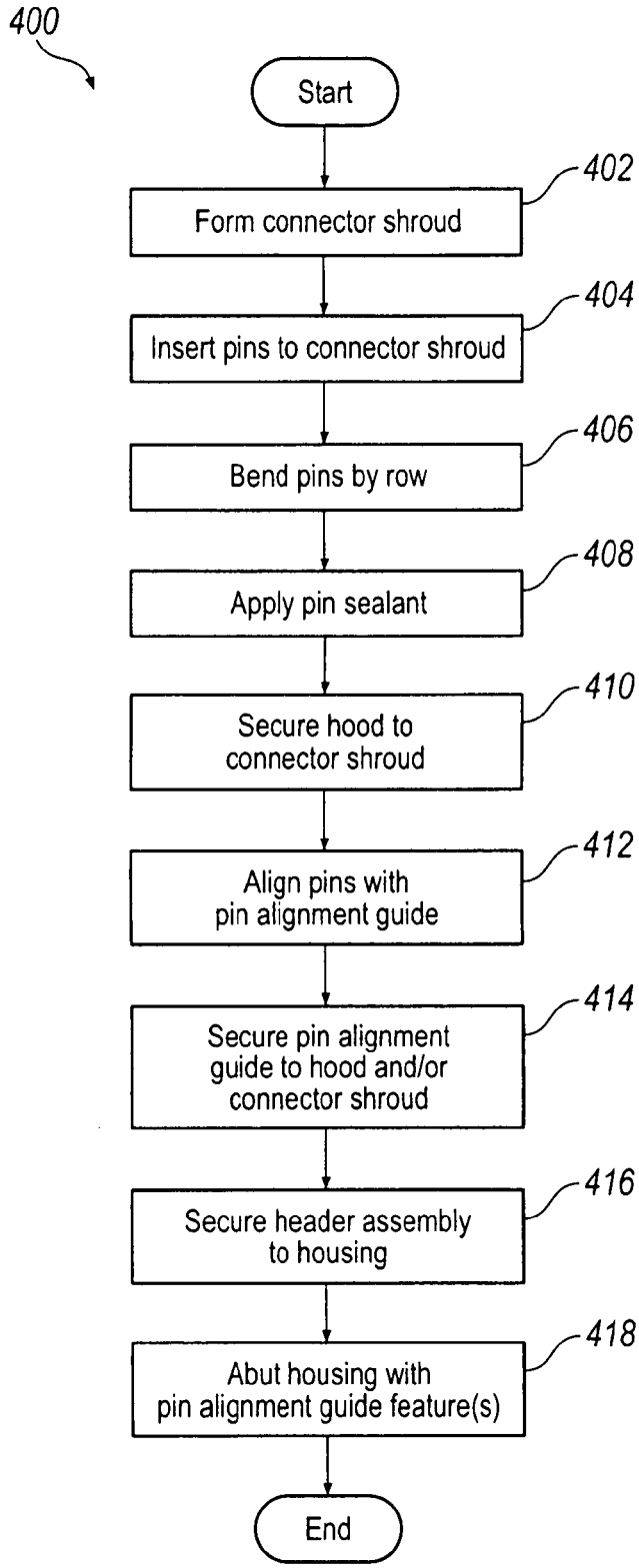
FIG. 4 is a process flow diagram for manufacturing an exemplary connection header.

Turning now to FIG. 4, an exemplary process 400 for assembling a header assembly 102 to a plug-in connector 100 is illustrated. Process 400 begins at step 402, where connector shroud 106 is formed. For example, connector shroud 106 and pin block 114 may be integrally formed together in a single mold. A mold for forming connector shroud 106 may be provided in two halves, with a plurality of core pins for forming apertures 116 in connector shroud 106. A mold for forming an integral pin block 114 preferably includes core pins disposed on an interior surface of one half of the mold. The core pins may engage an opposing interior surface of the mold to support the core pins during formation of pin block 114. Accordingly, pin apertures 116 are formed when material is injected into the mold around the core pins to form connector shroud 106. Core pins for forming apertures 116 are preferably aligned generally parallel with a longitudinal axis A of connector shroud 106 (see FIG. 2), such that a portion of the mold which retains the core pins may move parallel to longitudinal axis A to allow for removal of the formed connector shroud 106 and improve engagement of the core pins with the opposing inner face of the mold for subsequent operations. Other configurations of connector shroud 106 and methods for forming connector shroud 106 may be employed.

At step 404, a plurality of pins are inserted into a connector shroud 106. For example, pins 110 may be inserted into connector shroud 106 to a predetermined distance. An expanded feature 124 of pins 110 may be provided to engage an interior surface of pin apertures 116, as described above. Apertures 116 may generally receive a first portion 118 of each pin 110. First portion 118 may remain parallel to pin apertures 116 after insertion.

At step 406 pins 110 are bent by row to form a second portion 120, which is generally orthogonal to first portion 118 of pins 110. Second portion 120 may thus extend downward toward PCB 154, as described above. Each row of straight pins may be bent by any known pin bending process. For example, in one embodiment a brace element is positioned adjacent pin 110 at a desired bending point, and a bend tool then manipulates second portion 120 downward such that it is generally orthogonal to first portion 118. As shown in FIG. 3, connector shroud 106 is configured to generally allow access to each row of pins 110 *a,b,c,d* by a bend tool and a brace element prior to assembly of hood 108 to connector shroud 106. More specifically, a rear portion of connector shroud 106, where pins 110 are bent, generally does not extend beyond a desired bending point 111 of at least one of pins 110, and preferably at least one row or other grouping of pins 10. Accordingly, the number of pin rows that may be installed to connector shroud 106 is not limited by the interference of bending tools with connector shroud 106. Although pins 110 are described as being inserted to connector shroud 106 in step 402 and bent in step 406, pins 110 may also be bent prior to or after insertion into connector shroud 106. Process 400 may then proceed to step 408, which is optional. Where optional step 408 is not included, process 400 may proceed directly to step 410.

At step 408, pin sealant 122 may be applied adjacent pin apertures 116 of connector shroud 106. A semi-liquid sealant may be applied directly adjacent pin apertures 116 by an applicator nozzle. Pin sealant 122 may be hardened or cured. Preferably, an applicator nozzle is narrow to facilitate precise application of sealant about each aperture 116 within connector shroud 106. Pin sealant 122 may be applied to either side of pin block 114. Pin sealant 122 may advantageously provide a sealed interface between pins 110 and connector shroud 106 to generally prevent intrusion of contaminants such as a moisture, dirt, etc.

At step 410, hood 108 is secured to connector shroud 106. Hood 108 and shroud 106 may be provided with complimentary tongue and groove features, as described above, which provide a secure engagement therebetween. Further, a sealant or adhesive may be applied about a perimeter of hood 108 or shroud 106 to provide a sealed connection between hood 108 and shroud 106, thereby minimizing intrusion of moisture, dirt or other contaminants through an interface between hood 108 and shroud 106. As shown in the Figures, hood 108 may be secured to connector shroud 106 such that hood 108 extends beyond a bend point 111 of at least one pin 110. Hood 108 thus provides protection for pins 110 from external interference or contamination, and allows bending tools to access at least one pin 110 during assembly of header assembly 102.

At step 412, pin alignment guide 112 may be provided to align or support second portions 120 of pins 110. For example, as described above, apertures 134 may be provided in a base portion 136 of pin alignment guide 112 to generally prevent lateral displacement of pins 110. Accordingly, pin alignment guide 112 inhibits misalignment of pins 110 that may occur prior to assembly of connection header 102 to housing 104. Process 400 may then proceed to step 414.

At step 414, pin alignment guide 112 is secured to hood 108 and/or connector shroud 106. For example, as described above, lock arms 138 may be provided in pin alignment guide 112 to engage a detent 132 or other complementary feature in hood 108, as illustrated in the Figures. Process 400 may then proceed to step 416, which is optional. In embodiments not including step 416, process 400 may proceed directly to step 418.

At step 416, hood 108 may be secured to housing 104. As generally described above, complementary features such as a tongue 130' and groove 128' may be provided in housing 104 and hood 108, respectively, to provide a secure engagement therebetween. Further, a sealant or adhesive may be provided and applied about a perimeter of hood 108 adjacent housing 104, or vice versa. A sealant or glue may desirably seal an interface between hood 108 and housing 104 to prevent intrusion of contaminants such as dirt or moisture into an interface between hood 108 and housing 104. In embodiments where sealants are provided at each of the interfaces between connector shroud 106 and hood 108, between pin apertures 116 and pins 110, and also between hood 108 and housing 104, header assembly 102 provides a substantially sealed enclosure for pins 110 and other internal components of plug-in connector 100, thereby inhibiting intrusion of external contaminants such as moisture, dirt, etc.

At step 418, pin alignment guide 112 abuts a top surface of housing 104 to prevent pin alignment guide 112 from being displaced through aperture 156 toward housing 104, and especially from contacting PCB 154. For example, pin alignment guide 112 may be provided with features such as those described above, including but not limited to, an extension arm which rests upon a top surface of housing 104. Process 400 may then terminate.

Accordingly, connection header 102 provides a generally modular header assembly for a plug-in connector which is low in profile, relatively simple to manufacture and install, and resists damage to pins 110 despite exposure to vibration, shock, or external contaminants. Hood 108 and connector shroud 106 generally allow access to pins 110 during any bending process, while pin alignment guide 112 provides a convenient and easily installed alignment feature for pins 110.

Reference in the specification to "one embodiment" or "an embodiment" means that a particular feature, structure, or characteristic described in connection with the embodiment is included in at least one embodiment. The phrase "in one embodiment" in various places in the specification does not necessarily refer to the same embodiment each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. An electrical connection header for securing to a housing enclosing an electrical device, comprising:

a plurality of electrical pins, each including a first portion and a second portion, said second portion oriented generally orthogonal to said first portion;

a connector shroud defining a plurality of pin apertures, each of said first portions of said pins inserted into one of said pin apertures, said first portions oriented generally parallel with said apertures of said connector shroud; and a hood secured to said connector shroud and configured to be secured to the housing to generally conceal said pins, said hood extending beyond a bend point of at least one of said pins;

wherein said pins are configured to extend through an aperture of the housing to contact the electrical device when the electrical connection header is secured to the housing.

2. The electrical connection header of claim 1, wherein said connector shroud includes an integral pin block, said integral pin block defining said plurality of pin apertures.

3. The electrical connection header of claim 1, wherein said connector shroud is configured to receive a mating connector.

4. The electrical connection header of claim 1, further comprising a pin sealant disposed about said pin apertures.

5. The electrical connection header of claim 1, wherein said first portion of said pins includes an expanded portion for engaging an interior surface of said pin apertures.

6. The electrical connection header of claim 1, further comprising a pin alignment guide secured to one of said hood and said connector shroud, said pin alignment guide aligning said second portion of said pins, said pin alignment guide defining at least one abutment feature for abutting a top surface of the housing for the electrical device.

7. The electrical header of claim 6, wherein said pin alignment guide defines a plurality of pin alignment apertures for encircling said second portion of said pins.

8. The electrical connection header of claim 6, wherein said pin alignment guide includes a lock arm for engaging said one of said hood and said connector shroud.

9. The electrical connection header of claim 1, wherein said hood defines one of a tongue and a groove, and the housing defines the other of said tongue and said groove, said tongue and said groove providing a cooperating engagement between said hood and the housing.

10. The electrical connection header of claim 9, further comprising one of a sealant and an adhesive, said one of said sealant and said adhesive disposed about one of said tongue and said groove to secure said hood to the housing.

11. The electrical connection header of claim 1, wherein said hood defines one of a tongue and a groove, and said connector shroud defines the other of said tongue and said groove, said tongue and said groove providing a cooperating engagement between said hood and said connector shroud.

12. The electrical connection header of claim 11, further comprising one of a sealant and an adhesive, said one of said sealant and said adhesive disposed about one of said tongue and said groove to secure said hood to said connector shroud.

13. A method of assembling a connection header for securing to a housing enclosing an electrical device, comprising:

inserting a first portion of a plurality of pins into a plurality of pin apertures defined by a connector shroud;

bending said pins to form a second portion of said pins generally orthogonal to said first portion of said pins; and securing a hood to said connector shroud, said hood extending beyond a bend point of at least one of said pins and configured to be secured to the housing to generally conceal said pins;

wherein said pins are configured to extend through an aperture of the housing to contact the electrical device when the electrical connection header is secured to the housing.

14. The method of claim 13, further comprising integrally forming a pin block with said connector shroud, said pin block defining said plurality of pin apertures.

15. The method of claim 13, further comprising securing said hood to the housing.

16. The method of claim 13, further comprising applying a pin sealant about said pin apertures to seal an interface between said pins and said pin apertures.

17. The method of claim 13, further comprising providing an expanded feature in said first portion of said pins to engage an interior surface of said pin apertures.

18. The method of claim 13, further comprising:

aligning said second portion of said pins with a pin alignment guide;

securing said pin alignment guide to one of said hood and said connector shroud; and abutting a top surface of a housing of the electrical device with an abutment feature of said pin alignment guide.

19. The method of claim 18, further comprising aligning said second portion of said pins with a plurality of pin alignment apertures in said pin alignment guide.

20. The method of claim 18, wherein securing said pin alignment guide to said one of said hood and said connector shroud includes engaging a lock arm of said pin alignment guide with said one of said hood and said connector shroud.

21. The method of claim 13, further comprising:

providing one of a tongue feature and a groove feature on said hood;

providing the other of said tongue and said groove feature on the housing; and engaging said tongue with said groove feature to secure said hood to the housing.

22. The method of claim 21, further comprising applying one of an adhesive and a sealant to one of said tongue and said groove feature.

23. The method of claim 13, further comprising:

providing one of a tongue feature and a groove feature on said hood;

providing the other of said tongue and said groove feature on said connector shroud; and engaging said tongue with said groove feature to secure said hood to said connector shroud.

24. The method of claim 23, further comprising applying one of an adhesive and a sealant to one of said tongue and said groove feature.

25. An electrical device, comprising:

a housing defining an aperture; and an electrical connection header secured to said housing and disposed adjacent said aperture, including:

a plurality of electrical pins extending through said aperture, each including a first portion and a second portion, said second portions oriented generally orthogonal to said first portion;

a connector shroud defining a plurality of pin apertures, said first portions of said pins inserted into one of said pin apertures; and a hood secured to said connector shroud, said hood extending beyond a bend point of at least one of said pins.

26. The electrical device of claim 25, wherein the electrical connection header includes a pin alignment guide secured to one of said hood and said connector shroud, said pin alignment guide aligning said second portion of said pins, said pin alignment guide defining at least one abutment feature for abutting said upper surface of said housing.

27. The electrical device of claim 25, wherein said connector shroud includes an integral pin block defining said plurality of apertures.

28. The electrical device of claim 25, further comprising a printed circuit board disposed within the housing.

29. The electrical device of claim 25, said plurality of pins arranged in at least four rows in said pin block.

* * * * *